US005733232A

United States Patent [19]

Hsu

[11] Patent Number: 5,733,232

[45] Date of Patent: Mar. 31, 1998

[54] MULTI-PURPOSE EXERCISE MACHINE

[76] Inventor: Hank Hsu, 8F-14, No. 16, Lane 609, Sec. 5, Chung Hsin Rd., Sanchung, Taipei, Taiwan

[21] Appl. No.: 633,494

[22] Filed: Apr. 17, 1996

[51] Int. Cl.[6] ..... A63B 22/04

[52] U.S. Cl. ..... 482/133; 482/53; 482/96; 482/112; 482/129

[58] Field of Search ..... 482/51–53, 56, 482/62, 95, 96, 112, 122, 123, 129, 130, 131

[56] References Cited

U.S. PATENT DOCUMENTS

| | | | |
|---|---|---|---|
| 3,792,860 | 2/1974 | Selnes | 482/51 X |
| 4,909,504 | 3/1990 | Yang | 482/51 X |
| 5,000,441 | 3/1991 | Wang | 482/112 X |
| 5,378,209 | 1/1995 | Kendren | 482/52 |
| 5,505,679 | 4/1996 | McBride et al. | 482/52 X |

*Primary Examiner*—Richard J. Apley
*Assistant Examiner*—John Mulcahy
*Attorney, Agent, or Firm*—Browdy and Neimark

[57] ABSTRACT

A multi-purpose exercise machine comprises a frame unit, a sitting and treading unit, an arm rod unit, a pulley unit, a releasing unit, a back rest, and a seat. The frame unit has a bottom frame provided with a first support rod and a second support rod. The sitting and treading unit is fastened with the first support rod and the second support rod. The arm rod unit is fastened pivotally with the first support rod and the second support rod and is provided with grips. The arm rod unit is connected with the ropes of the pulley unit. The ropes are fastened with the releasing unit such that the arm rod unit and the sitting and treading unit are linked. The seat is provided with a main rod having a hooked rod engageable with the sitting and treading boards.

7 Claims, 5 Drawing Sheets

MULTI-PURPOSE EXERCISE MACHINE

FIELD OF THE INVENTION

The present invention relates generally to an exercise machine, and more particularly to a multi-purpose exercise machine.

BACKGROUND OF THE INVENTION

As shown in FIG. 1, a multi-purpose exercise machine of the prior art comprises a frame unit 1, a pulley unit 2, a plurality of weights 3, a lifting mechanism 4, and a chest-building mechanism 5. Such a prior art exercise machine as described above is rather cumbersome and complicated in construction.

SUMMARY OF THE INVENTION

It is therefore the primary objective of the present invention to provide a multi-purpose exercise machine, which is compact and simple in construction.

It is another objective of the present invention to provide a multi-purpose exercise machine devoid of the weights of the prior art exercise machine.

The foregoing objectives of the present invention are attained by a multi-purpose exercise machine, which comprises a frame unit, a sitting and treading unit, an arm rod unit, a pulley unit, a releasing unit, a back rest, and a seat. The frame unit has a bottom frame provided with a first support rod and a second support rod. The sitting and treading unit is fastened with the first support rod and the second support rod. The arm rod unit is fastened pivotally with the first support rod and the second support rod and is provided with grips. The arm rod unit is connected with the ropes of the pulley unit. The ropes are fastened with the releasing unit such that the arm rod unit and the sitting and treading unit are linked.

The foregoing objectives, features and functions of the present invention will be more readily understood upon a thoughtful deliberation of the following detailed description of the present invention in conjunction with the accompanying drawings.

DETAILED DESCRIPTION OF THE INVENTION

Figure 1:
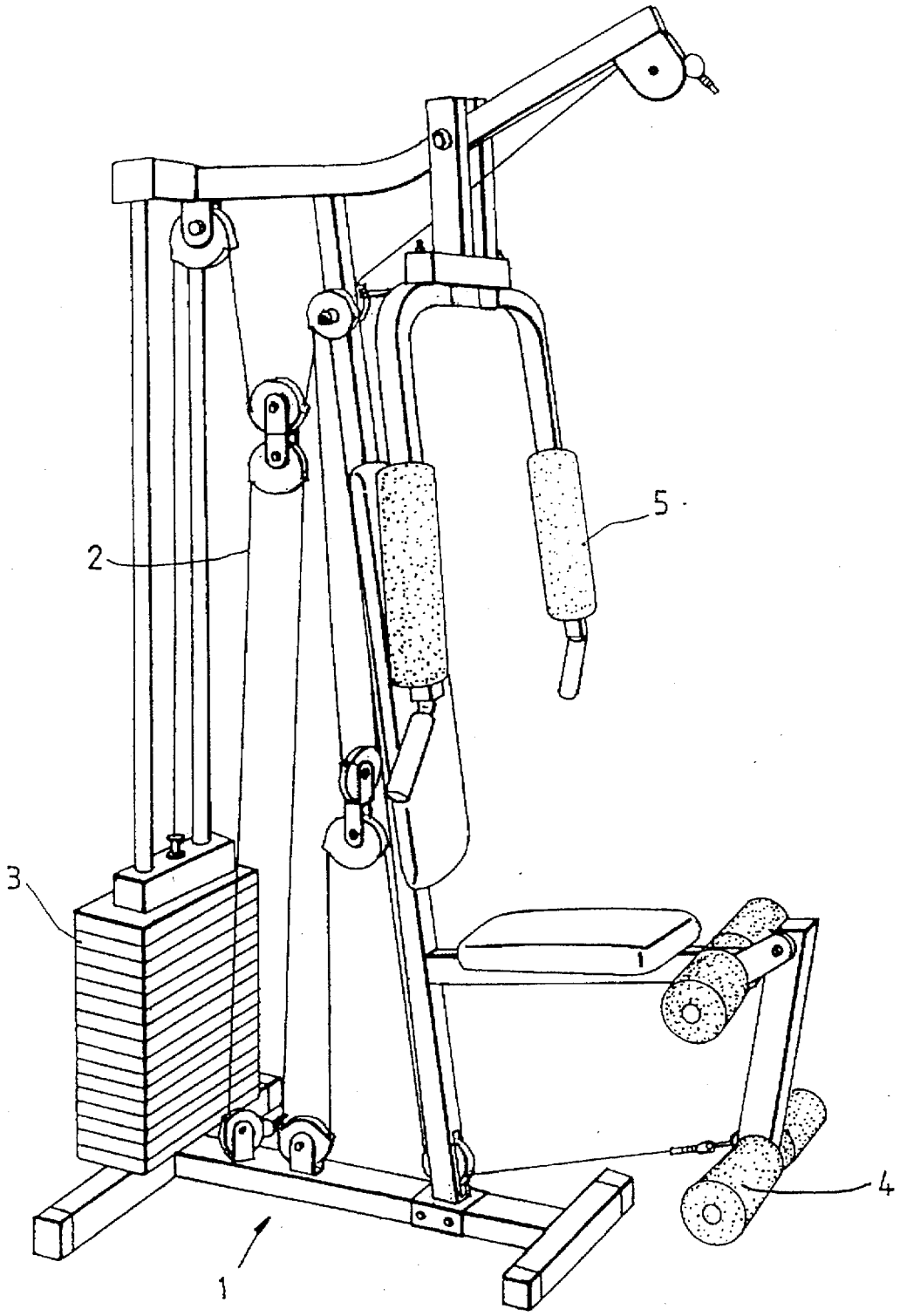
FIG. 1 PRIOR ART
FIG. 1 shows a perspective view of a multi-purpose exercise machine of the prior art.
Figure 2:
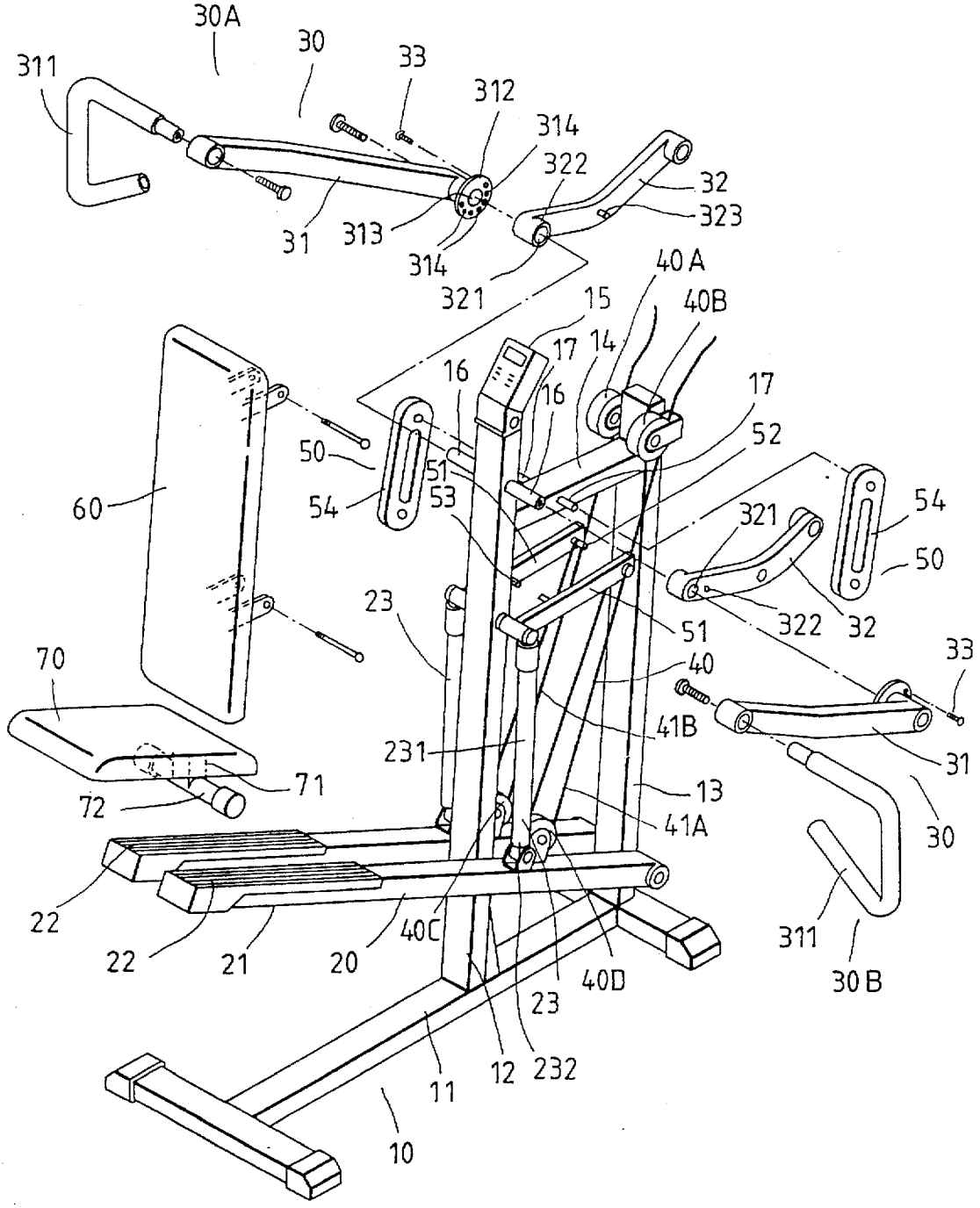
FIG. 2 shows a perspective view of a multi-purpose exercise machine of the present invention.
Figure 3:
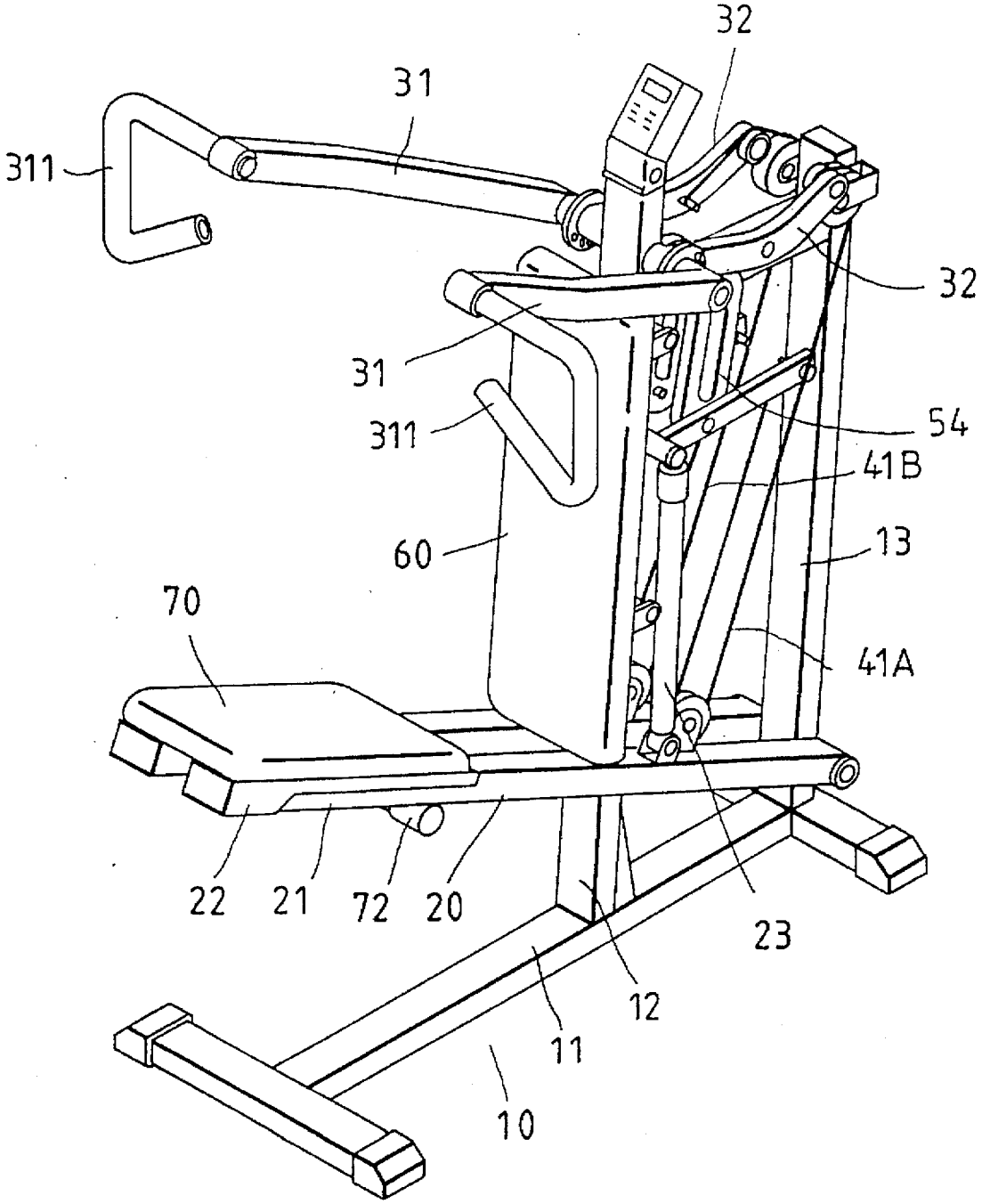
FIG. 3 shows an exploded view of the multi-purpose exercise machine of the present invention.

As shown in FIGS. 2 and 3, a multi-purpose exercise machine embodied in the present invention is composed of a frame unit 10, a sitting and treading unit 20, an arm rod unit 30, a pulley unit 40, a releasing unit 50, a back rest 60, and a seat 70.

The frame unit 10 has a bottom frame 11 provided with a first support rod 12 and a second support rod 13, which are parallel to each other and are connected at the upper ends thereof with a third support rod 14 for stabilizing the first support rod 12 and the second support rod 13. The first support rod 12 is provided at the top end thereof with a displaying device 15 and is further provided respectively at both ends of the lower edge thereof with an insertion rod 16. The third support rod 13 is provided respectively on both sides of a predetermined portion thereof with a fastening column 17.

The sitting and treading unit 20 has two sitting and treading boards 21, which are fastened pivotally and respectively at one end thereof with the second support rod 13. Each of the sitting and treading boards 21 is provided thereon with a pad 22 attached thereto and is further provided with an expansion mechanism 23 comprising a hydraulic cylinder 231 having a cylinder body 232 and a piston rod 233 fastened pivotally with the first support rod 12.

The arm rod unit 30 has two symmetrical arm rod members 30A and 30B comprising a first arm rod 31 and a second arm rod 32. The first arm rod 31 is provided at one end thereof with a grip 311 fastened pivotally thereto and at another end thereof with a disk portion 312 having at the center thereof a first insertion hole 313 and a plurality of first locating holes 314. The second arm rod 32 is provided with a second insertion hole 321, a second locating hole 322, and a round column 323. In combination, the second insertion hole 321 of the second arm rod 32 is fitted over the insertion rod 16 of the first support rod 12. The first insertion hole 313 of the first arm rod 31 is then fitted over the insertion rod 16 such that the disk portion 312 of the first arm rod 31 is in contact with the outer end surface of the second arm rod 32. Thereafter, one of the first locating holes 314 is aligned with the second locating hole 322 of the second arm rod 32 before a locating column 33 is received in the locating holes 314 and 322. As a result, the first arm rod 31 and the second arm rod 32 form a specific angle for doing a specific exercise.

The pulley unit 40 has four rotary wheel fitting members 40A–40D. The rotary wheel fitting members 40A and 40B are mounted symmetrically on the top end of the second support rod 13 while the rotary wheel fitting members 40C and 40D are mounted symmetrically at the center of each sitting and treading board 21. The pulley unit 40 has two ropes 41A and 41B, which are fastened respectively at one end thereof with the round column 323. The ropes 41A and 41B run through the rotary wheel fitting members 40A–40D before being fastened with the releasing unit 50.

The releasing unit 50 has two symmetrical cross beams 51 which are fastened respectively at one end thereof with the first support rod 12 and are provided respectively at another end thereof with a round column 52 engaging the ends of the ropes 41A and 41B. The cross beams 51 are provided respectively at the center thereof with a fastening column 53 symmetrical with the fastening column 17 of the third support rod 13 and having an elastic plastic piece 54.

The back rest 60 of a rectangular construction is fastened with the first support rod 12.

The seat 70 of a rectangular construction has a main rod 71 provided with a hooked rod 72 for securing the seat 70 to the sitting and treading boards 21.

Figure 6:
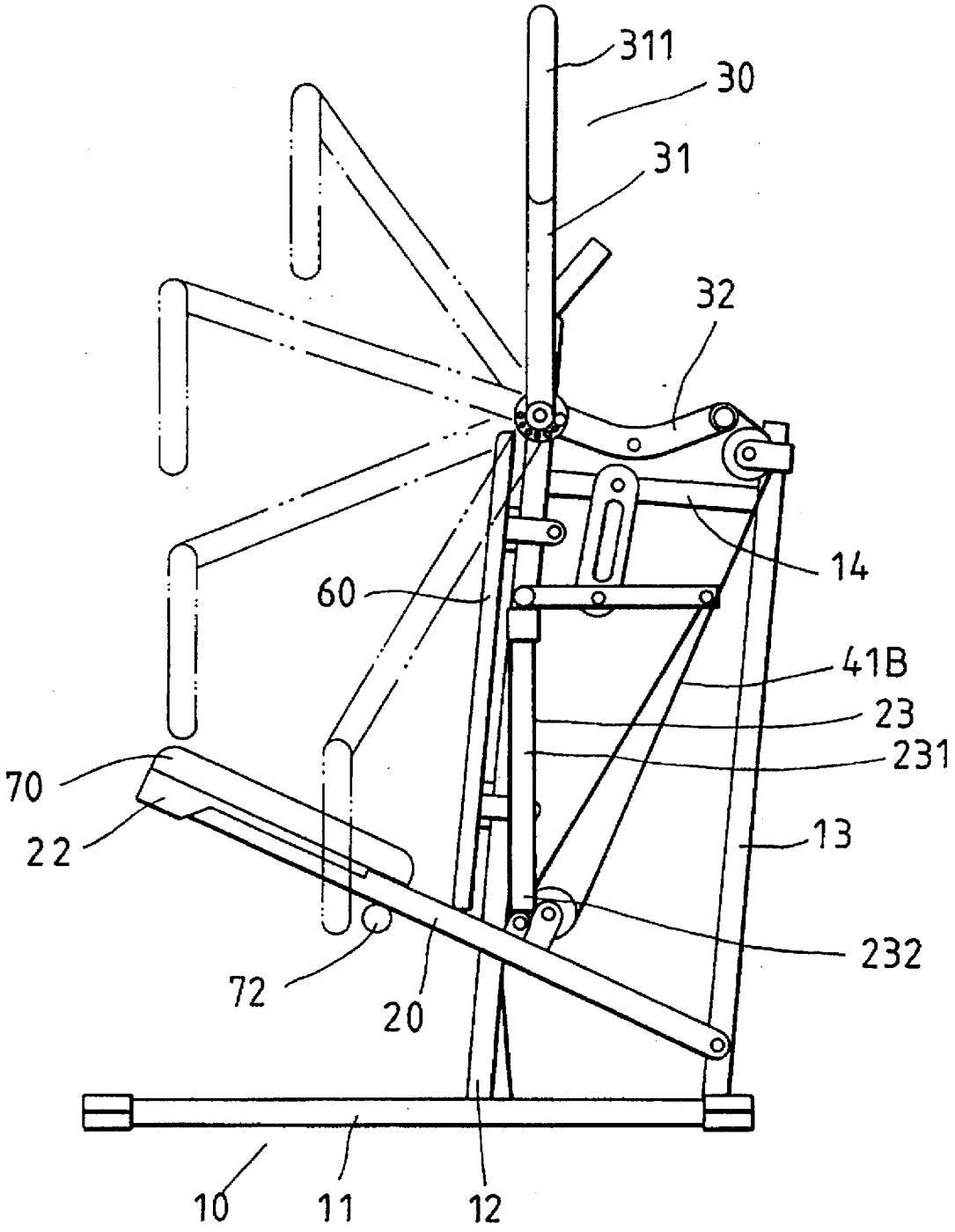
FIG. 6 shows a schematic view illustrating the mechanisms of the present invention at work.

As shown in FIG. 6, when the sitting and treading boards 21 are not treaded, the cross beam 51 is raised by the elastic plastic piece 54. The boards 21 are slanted by the ropes 41A and 41B.

Figure 4:
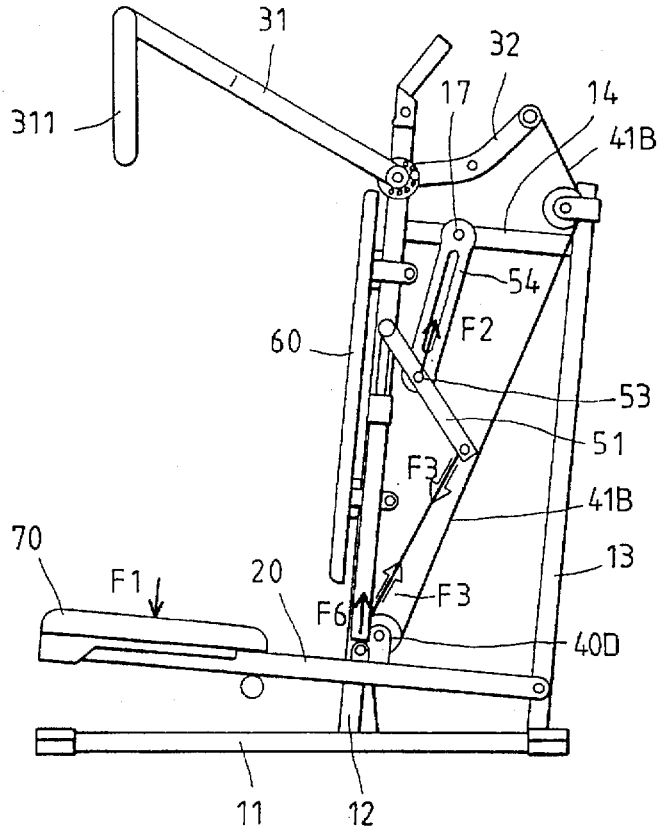
FIG. 4 shows a side elevational view of the present invention not in action.

As shown in FIG. 4, when the seat 70 is treaded, the elastic plastic piece 54 is deformed by a force of gravity F1 to bring about an elastic force F2, which is transmitted by the rope 41B to cause the rotary wheel fitting member 40D of the sitting and treading board 21 to generate an upward pulling force F3. In addition, the hydraulic cylinder 23 is caused to bring about a counter resistance F6.

Figure 5:
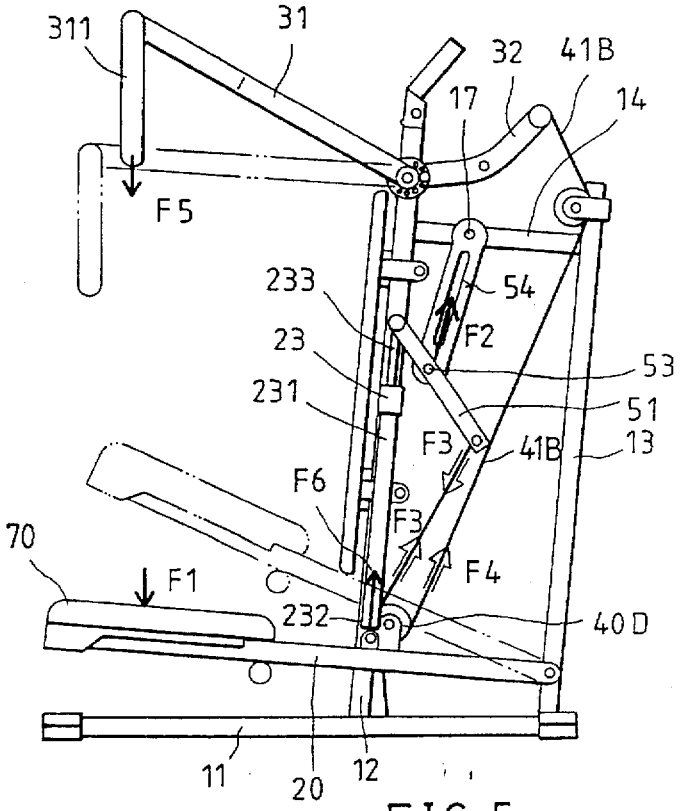
FIG. 5 shows a side elevational view of the present invention at work.

As shown in FIG. 5, the first arm rod 31 is caused to bring about a downward force F4 when the first arm rod 31 is forced to move downwards by an exerciser. The force F4 is transmitted via the rope 41B to the rotary wheel fitting member 40D so as to form a pulling force F5. As a result, the boards 21 are raised.

In other words, the machine of the present invention is capable of making use of the weight of an exerciser as a source of the load gravity.

The machine of the present invention can be used for building the muscles of different parts of the body by adjusting the angle formed by the first arm rod 31 and the second arm rod 32. If the first arm rod 31 is adjusted to the lower position, the exerciser can stand on the seat 70 to pull the first arm rod 31. If the first arm rod 31 is adjusted to the middle position, the exerciser can sit on the seat 70 to push the first arm rod 31. If the first arm rod 31 is adjusted to the upper position, the exerciser can sit on the seat 70 to pull downwards the first arm rod 31. The machine of the present invention can be used as a walking machine by removing the seat 70 and by adjusting the first arm rod to be right at the upper position.

What is claimed is:

1. A multi-purpose exercise machine comprising:

a frame unit having a bottom frame provided with a first support rod and a second support rod;

a sitting and treading unit having two sitting and treading boards, which are fastened pivotally and respectively at one end thereof with said second support rod;

an arm rod unit having two arm rod members fastened pivotally and respectively with said first support rod and provided respectively at one end thereof with a grip;

a pulley unit comprising ropes each fastened at one respective end thereof with another end of said arm rod members, and pulleys attached to said sitting and treading boards, the ropes being disposed about the pulleys; and a releasing unit fastened with the other ends of said ropes such that said arm rod members and said sitting and treading boards are linked via the ropes disposed about the pulleys on the sitting and treading boards;

and further comprising a seat provided with a main rod having a hooked rod engageable with said sitting and treading boards.

2. The machine as defined in claim 1, wherein said arm rod unit comprises a first arm rod and a second arm rod and means for adjusting an angle between the first arm rod and the second arm rod.

3. The machine as defined in claim 1 further comprising two expansion mechanisms which are fastened pivotally with said first support rod and said sitting and treading boards.

4. The machine as defined in claim 1 further comprising a third support rod connecting said first support rod and said second support rod.

5. The machine as defined in claim 1 further comprising a back rest fastened with said first support rod.

6. The machine as defined in claim 1, wherein said releasing unit has an elastic plastic piece capable of bringing about an elastic force.

7. The machine as defined in claim 6, wherein said elastic plastic piece is fastened at one end thereof with said third support rod and at another end thereof with a cross beam connected with said ropes of said pulley unit.

* * * * *